US006321630B1

(12) United States Patent
Woodall et al.

(10) Patent No.: US 6,321,630 B1
(45) Date of Patent: Nov. 27, 2001

(54) THERMOSET/THERMOPLASTIC LINE CHARGE WITH CONTOURED FABRIC FASTENING AND DETONATING CORD MANAGEMENT SYSTEM AND ASSEMBLY PROCESS

(75) Inventors: Robert Woodall, Lynn Haven; Felipe Garcia, Panama City, both of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/536,491

(22) Filed: Mar. 27, 2000

(51) Int. Cl.[7] ..... B64D 1/04; F41F 5/00
(52) U.S. Cl. ..... 89/1.13; 102/403
(58) Field of Search ..... 89/1.13; 102/323, 102/403

(56) References Cited

U.S. PATENT DOCUMENTS

| | | | | |
|---|---|---|---|---|
| 2,433,875 | * | 1/1948 | Walker et al. | 102/403 |
| 3,000,303 | * | 9/1961 | Littleton | 102/403 |
| 3,114,316 | * | 12/1963 | Littleton | 102/403 |
| 3,351,010 | * | 11/1967 | Ainslie et al. | 102/387 |
| 3,515,068 | * | 6/1970 | Galko | 102/403 |
| 3,724,319 | * | 4/1973 | Zabelka et al. | 89/1 |

* cited by examiner

*Primary Examiner*—Michael J. Carone
*Assistant Examiner*—Michelle Thomson
(74) *Attorney, Agent, or Firm*—Harvey A. Gilbert; Donald G. Peck

(57) ABSTRACT

A line charge for deploying explosive charges across obstacles and mines to clear a safe lane has explosive charges spaced apart on a common detonating cord, and axial passageways in the explosive charges are sized to permit free longitudinal travel of the detonating cord through them. A composite strength member includes an inner fabric sleeve of high strength flexible material covered by an outer sleeve of thermoset/thermoplastic material and contains the explosive charges and detonating cord. Heat-curing the inner fabric sleeve and outer sleeve shrinks and conforms them to the outer contours of the explosive charges and combines the high strength flexible material and thermoset/thermoplastic material. Composite strength member absorbs energy during deployment of the line charge over its entire length and circumference and absorbs more energy prior to structural failure to allow the use of more powerful rocket motors to fly longer line charges from much greater and safer standoff distances. Composite strength member does not transfer self-destructive strains to the detonating cord during deployment; the detonating cord is free to longitudinally slide through the explosive charges; and composite strength member maintains proper spacing of explosive charges so that explosive effectiveness of the line charge is maximized. The cost effective and uncomplicated assembly procedure for the line charge creates a more reliable line charge having improved performance capabilities as compared to contemporary manufacturing schemes.

10 Claims, 2 Drawing Sheets

THERMOSET/THERMOPLASTIC LINE CHARGE WITH CONTOURED FABRIC FASTENING AND DETONATING CORD MANAGEMENT SYSTEM AND ASSEMBLY PROCESS

CROSS REFERENCE TO RELATED APPLICATIONS

This is a continuation in part of copending U.S. patent applications entitled "Reliable and Effective Line Charge System" by Felipe Garcia et al., U.S. Patent and Trademark Office Ser. No. 09/012932 (NC 78,433), filed Jan. 24, 1998 and issued as U.S. Pat. No. 6,205,903, "Line Charge Insensitive Munition Warhead" by Felipe Garcia et al., U.S. Patent and Trademark Office Ser. No. 07/944049 (NC 78,448), filed Sept. 12, 1997 and issued as U.S. Pat. No. 5,932,835, "Line Charge Connector" by Felipe Garcia et al., U.S. Patent and Trademark Office Ser. No. 09/030518 (NC 78,635), filed Feb. 12, 1998, and "Line Charge Fastener and Detonating Cord Guide" by Felipe Garcia et al., U.S. Patent and Trademark Office Ser. No. 09/034722 (NC 78,878), filed Mar. 2, 1998 and issued as U.S. Pat. No. 5,959,233, and incorporates all references and information thereof by reference herein.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to munitions deployed in line charges. In particular, this invention relates to line charges having shrinkable exterior sleeves over tubular fabric strength members that hold explosive charges and detonating cords.

The use of line charge systems by the military to create safe lanes in mine and obstacle fields is well known. Usually, these systems are launched from a relatively safer launch point by a rocket that pulls the line charge out of a container to fly downrange and drape over obstacles and mines. The number of explosives in the line charge is detonated a short time later to clear a path.

Various designs of the air-launched line charge systems have evolved, and have shown varying degrees of effectiveness. Some designs cannot withstand the rigors of deployment and fail, or the air-launched line charges don't go where they are intended to go. Many are incapable of detonating reliably. One thing that most designs do have had in common, however, is that the manufacturing processes for the concatenated arrangements of explosives and detonators were labor and/or tooling intensive. Consequently, the complicated manufacturing processes not only made contemporary line charges too expensive but also compromised their reliability.

Thus, in accordance with this inventive concept, a need has been recognized in the state of the art for cost effective manufacturing processes for rocket launched line charges of warheads used for obstacle and mine clearing as single dimensional line charges or two dimensional distributed arrays.

SUMMARY OF THE INVENTION

The present invention is directed to providing an improved line charge and assembly procedure therefor. A composite strength member conforms to outer rounded contours of a plurality of spaced-apart explosive charges. The explosive charges have longitudinal passageways to permit free longitudinal travel of a detonating cord through them. The composite strength member has an inner fabric sleeve covered by an outer sleeve of thermoset/thermoplastic material that shapes and holds the inner fabric sleeve on the explosive charges and permits free longitudinal travel of the detonating cord through the explosive charges An object of the invention is to provide an improved line charge and method of manufacture thereof.

Another object of the invention is to provide a lower cost line charge that is less complicated and less time consuming to assemble.

Another object of the invention is to provide a method of manufacturing a cost-effective line charge having a lightweight management system for detonating cord and fastening system for spaced explosive charges.

Another object of the invention is to provide a lightweight, strong, and low cost line charge having a thermoset/thermoplastic outer sleeve heat shrunk to combine with a fabric sleeve as the strength element.

Another object of the invention is to provide a line charge assembled to have a thermoset/thermoplastic outer sleeve heat shrunk to conform a fabric sleeve to explosive charges to secure their position and absorb excess loading as the system is launched via rocket, mortar, or other less severe deployment means.

Another object of the invention is to provide a line charge assembled to have a thermoset/thermoplastic outer sleeve heat shrunk to conform a fabric sleeve to explosive charges to secure their position and absorb excess loading while simultaneously providing strain relief for a detonating cord running through the center of the explosive charges.

Another object of the invention is to provide an array of explosive charges in one or two-dimensional spacing for blast or directional effects above water, underwater or underground, and for signaling devices that stream discontinuous payloads.

Another object of the invention is to provide a line charge assembled to provide strain relief for the detonating cord and hold the explosive charges in proper alignment and spacing while absorbing variable shocks through various fabrics, weaves and different thermoset/thermoplastic compositions.

Another object of the invention is to provide a line charge assembled to absorb most of the energy transmitted during launch by an outer composite fabric strength member and minimize any stretching of a weaker detonating cord.

Another object of the invention is to provide a line charge assembled to have elasticity of the fabric strength member to allow the line charge to stretch upon launch and return to its original position upon landing to limit the peak acceleration of explosive charges by spreading launch forces over a longer time period.

Another object of the invention is to provide a line charge assembled to have an elastic fabric strength member stretching upon launch and returning to its original length upon landing to return the relative spacings of the explosive charges to their original positions, or spacings for maximized explosive effectiveness.

Another object of the invention is to provide a line charge assembled to have an outer composite strength member making greater surface contact with each explosive charge as compared to other external or internal elongate strength members.

Another object of the invention is to provide a line charge allowing more energy to be absorbed by the composite strength member prior to structural failure so that much more powerful rocket motors may fly heavier and longer line charges from much greater and safer standoff distances.

These and other objects of the invention will become more readily apparent from the ensuing specification when taken in conjunction with the appended claims.

DESCRIPTION OF THE PREFERRED EMBODIMENTS

Figure 1:
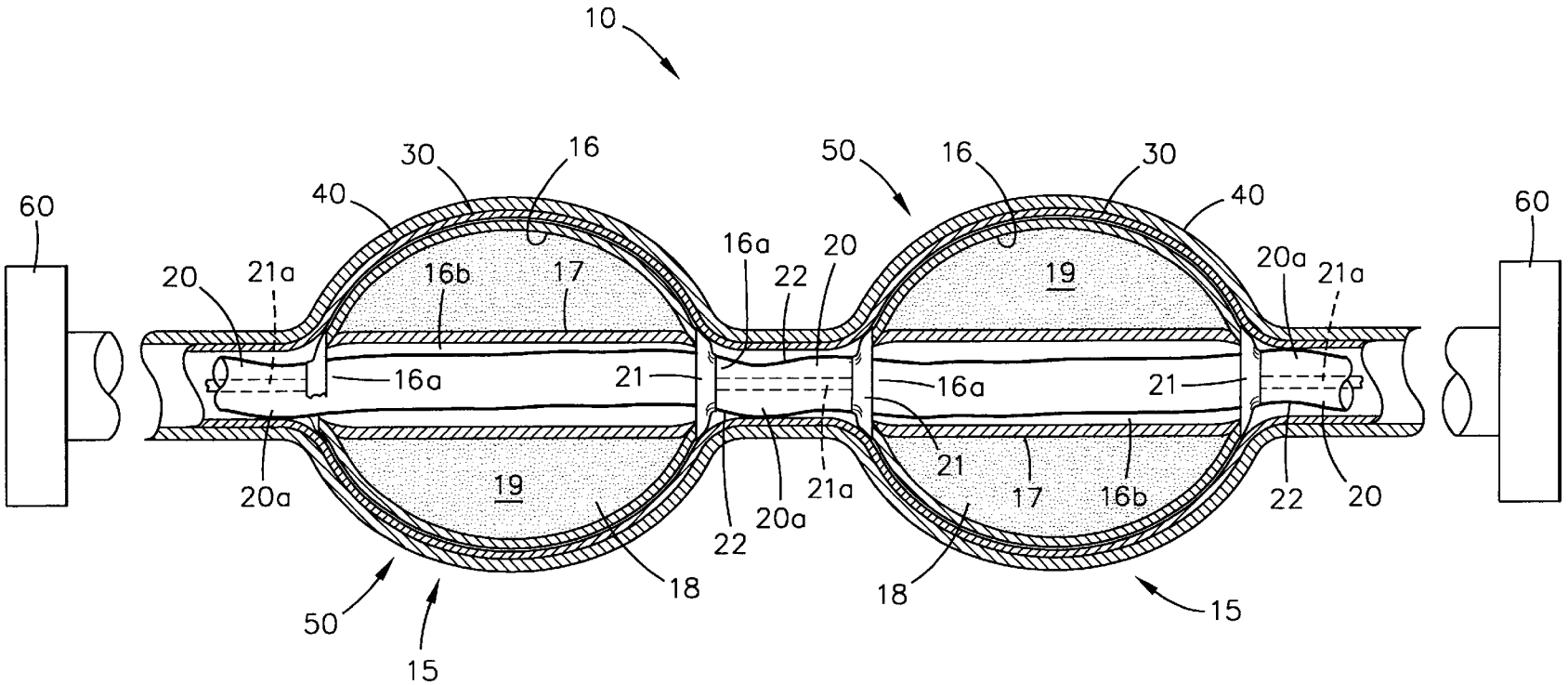
FIG. 1 is a schematic side view of the line charge in accordance with this invention.

Referring to FIG. 1 of the drawings, line charge 10 fabricated in accordance with this invention is more capable of reliably delivering an array of a number of explosive charges 15 to clear a path through obstacles and/or mines than contemporary breaching systems. For example, one noteworthy, contemporary line charge that has proven to be effective is disclosed in the above referenced, "Reliable and Effective Line Charge System."

The drawing only depicts a short section of line charge 10 having a pair of explosive charges 15; it is understood that the design and expedient method of manufacturing of line charge 10 as disclosed herein, make possible the assembly of line charges 10 of many practicable lengths, upwards of 20, 40 or more explosive charges 15, for example. Opposite ends of line charge 10 are terminated in connectors 60, such as disclosed in the above referenced, "Line Charge Connector" to enable coupling to other line charges 10 or to a rocket (not shown) that pulls line array 10 through the air or to a drogue chute (not shown) to provide drag that straightens and controls deployment.

Explosive charges 15 each have a metal or strong plastic shell 16 having rounded outer contours and openings 16*a* at opposite ends. A metal or plastic center tube 17 longitudinally extends the length of shell 16 to define an axial, or longitudinal passageway 16*b* from one side to the other of explosive charge 15. Center tube 17 may be integral with shell 16 or snugly fitted through openings 16*a*, and sealed at opposite ends around openings 16*a* of shell 16. Either way, chamber 18 is formed in shell 16 and is filled with explosive 19.

Explosive 19 may be any suitable explosive that withstands the rigors of launch and impact during deployment of line charge 10, and detonates to clear obstacles and mines according to the task at hand. Booster charges and other detonation aids may be included in explosive 19 to assure proper detonation and blast effects. Explosive charges 15 might be designed along the lines of the warheads, or grenades disclosed in the above referenced, "Line Charge Insensitive Munition Warhead."

Detonating cord 20 continuously extends through axial, or longitudinal passageways 16*b* in center tubes 17 of all explosive charges 15. Detonating cord 20 is not secured to any of explosive charges 15, but instead is sized to freely slide, or travel longitudinally through all center tubes 17. Thus, detonating cord 20 avoids self destructive loading and remains intact during the highly accelerated deployment of line charge 10. In other words, when a rocket attached to one end of line charge 10 is ignited and line charge 10 is pulled through the air across a target area, explosive charges 15 and detonating cord 20 are free to slide relative to one another and inertial loading of detonating cord 20 by explosive charges 15 is avoided. Thus, line charge 10 is more likely to survive launch and impact during its deployment by rocket, or other highly accelerating means.

During the assembly process of line charge 10, small tape strips, or rings 21 may be used to maintain explosive charges 15 in a predetermined spaced-apart relationship, or separation along detonating cord 20 before other components, to be elaborated on below, are assembled. The distances that explosive charges 15 are spaced apart are functions of the explosive effects that are needed in diverse tasks. Larger explosive charges 15 may permit greater distance between adjacent charges, and smaller explosive charges 15 may need to be closer together to clear certain obstacles, for example. Tape strips 21 are left on explosive charges 15 and detonating cord 20 throughout the assembly process. Initially, during launch of a line charge 10, inertial loading of explosive charges 15 pulls tape strips from detonating cord 20 and/or explosive charges 15. Thus, tape strips 21 do not interfere with free longitudinal motion of detonating cord 20 through tubes 17 of explosive charges 15 during launch and landing of line charge 10.

Line charge 10 may have additional short lengths 20*a* of detonating cord 20 that extend or twist out to the side between adjacent explosive charges 15. Each additional short length 20*a* of detonating cord 20 between adjacent explosive charges 15 is proportional to an amount of detonating cord 20 between adjacent explosive charges 15 and is in excess of the longitudinal length of composite strength member 50 that is located radially outward from the amount of detonating cord 20. Adding these additional short lengths 20*a* together makes the overall length of detonating cord 20 sufficiently longer than composite strength member 50 to prevent damage to detonating cord 20 when composite strength member 50 stretches to absorb shock during deployment of line charge 10. When such additional short lengths 20*a* are provided for, tape strips 21 may have one or more longitudinal linking portions 21*a* of tape extending between adjacent tape strips 21 to maintain the configuration of additional short lengths 20*a* during the successive steps of the assembly process of line charge 10.

An essentially tubular fabric sleeve 30 is sized to extend the length of line charge 10 and contain explosive charges 15 and detonating cord 20. Fabric sleeve 30 may be selected from a number of strong, flexible commercially available fabrics that have been woven or otherwise fashioned to contain explosive charges 15. These commercially available fibers may be many different natural and manmade fibers in many different patterns and weaves depending on the materials available and the strength requirements of the tasks. Typically, fabric sleeve 30 could be made from natural fibers such as cotton and linen, or manmade high strength fibers could be selected, such as nylon and fibers marketed under the trademarks KEVLAR and NOMAR by E. I. Dupont de Nemours Co., 1007 Market St., Wilmington, Del. 19898E.

The fabric of fabric sleeve 30, may be fashioned to have a tubular shape or other form such as the fabric strength member disclosed in the above referenced, "Line Charge Fastener and Detonating Cord Guide." However, fabric sleeve 30 distinguishes from the referenced guide by the synergistic combination of fabric sleeve 30 with outer sleeve 40 of thermoset/thermoplastic material to form composite strength member 50.

Outer sleeve 40 of thermoset/thermoplastic material covers fabric sleeve 30 from one end to the other, conforms fabric sleeve 30 to outer contours of explosive charges 15, and secures explosive charges 15 in the predetermined spaced-apart relationship, or separation from each other. This covering, conforming, and securing are caused by appropriate curing of the thermoset/thermoplastic material of outer sleeve 40. The curing involves application of heat at suitable temperatures to shrink the thermoset/thermoplastic material of outer sleeve 40 onto fabric sleeve 30 and compress fabric sleeve 30 into contiguous, or abutting contact on outer contours of explosive charges 15. Further curing by heat at suitable temperatures allows at least portions of outer sleeve 40 to melt and/or flow to combine with fabric of fabric sleeve 30. Subsequent cooling to lower temperatures below the temperatures of curing causes outer sleeve 40 and fabric sleeve 30 to act together as composite strength member 50 for line charge 10.

Inner fabric sleeve 30 and/or outer sleeve 40 is not contiguously conformed to or otherwise frictionally engaged by detonating cord 20. Instead, inner fabric sleeve 30 and/or outer sleeve 40 are brought near, or adjacent the outer surface of detonating cord 20 in a virtually friction-free relationship with detonating cord 20. Temperature control during curing in the assembly process may be one way to create separated but adjacent disposition of sleeves 30 and 40 and detonating cord 20.

Optionally, sleeves 22 of low friction material might also be around detonating cord 20 and short lengths 20*a* where they extend between adjacent explosive charges 15. Low-friction sleeves 22 help reduce the possibility of frictional engagement of detonating cord 20 by inner fabric sleeve 30 and/or outer sleeve 40, and assure friction-free relationship among components. Sleeves 22 might be made from low friction fabric or solid material marketed under the trademark TEFLON by E. I. Dupont de Nemours Co., 1007 Market St., Wilmington, Del. 19898.

Composite strength member 50 secures explosive charges 15 in the predetermined spaced-apart relationships that had been maintained by tape strips 21. Composite strength member 50 cradles the outer contours of each explosive charge 15. This cradling support allows flexure of composite strength member 50 so that greater inertial loads of more or heavier explosive charges 15 may be borne during deployment as compared to contemporary arrays. This flexure of composite strength member 50 does not transfer self-destructive strains to detonating cord 20 since detonating cord 20 is free to longitudinally slide through charges 15.

The thermoset/thermoplastic material for outer sleeve 40 can be made from several flexible and strong shrinkable products that shrink when they are subjected to appropriate temperatures for appropriate durations. Later, after the heat has been removed, these products retain the properties of being flexible and strong after they have been shrunken to grip or otherwise retain the shape of the object they have been shrunken onto. The terms "thermoset/thermoplastic" and "thermoplastic/thermoset" may be used interchangeably to refer to the chosen material for outer sleeve 40.

Thermoset/thermoplastic material for outer sleeve 40 can be selected from flexible and strong shrinkable products of the series marketed under the trademarks DAFLEX and DAFLON by Daburn Electronics & Cable Corp., 224 Pegasus Ave., Northvale, N.J. 07647. These DAFLEX and DAFLON series products include, but are not limited to the shrinkable product marketed by Daburn Electronics & Cable Corp. under the trademark NEOPRENE SH162; Daburn Electronics & Cable Corp.'s shrinkable products PVC SH265, irradiated polyolefins SH275, SH277, SH290, and Sh321; Daburn Electronics & Cable Corp.'s trademarked shrinkable product KYNAR SH350; the low friction shrinkable material marketed under the trademark TEFLON FEP SH400 by E. I. Dupont de Nemours Co., 1007 Market St., Wilmington, Del. 19898; Daburn Electronics & Cable Corp.'s shrinkable products Shrink/Melt SM270 and Shrink/Melt SM450; and the low friction shrinkable material marketed under the trademark TEFLON SH 621 by E. I. Dupont de Nemours Co., 1007 Market St., Wilmington, Del. 19898.

Greater strength for line charge 10 is provided for by composite strength member 50. Opposite ends of composite strength member 50 and detonating cord 20 are clamped or otherwise secured in connectors 60 that can be connected to other line charges 10. Since detonating cord 20 is longer than composite strength member 50 of each line charge 10, each composite strength member 50 exclusively bears the load as it stretches during rocket deployment, and each detonating cord 20 is not subjected to self-destructive tensile loads. Consequently, several line charges 10 could be joined together to extend to greater lengths to breach wider obstacle belts and may use connectors 60 such as disclosed in the above referenced, "Line Charge Connector."

Upon launch by a rocket, line charge 10 flies down range drapes over obstacles and, after a given delay, detonating cord 20 may detonate explosive charges 15. Detonation may be initiated by a tensile force actuated fuze (not shown) coupled to one end of detonating cord 20. A typical tensile actuated fuze is marketed by Roberts Research Lab., Torrance, Calif. and designated A191-10. Other fuzes, time delay fuses, standard blasting caps or blasting machines may detonate line charge 10.

Figure 2:
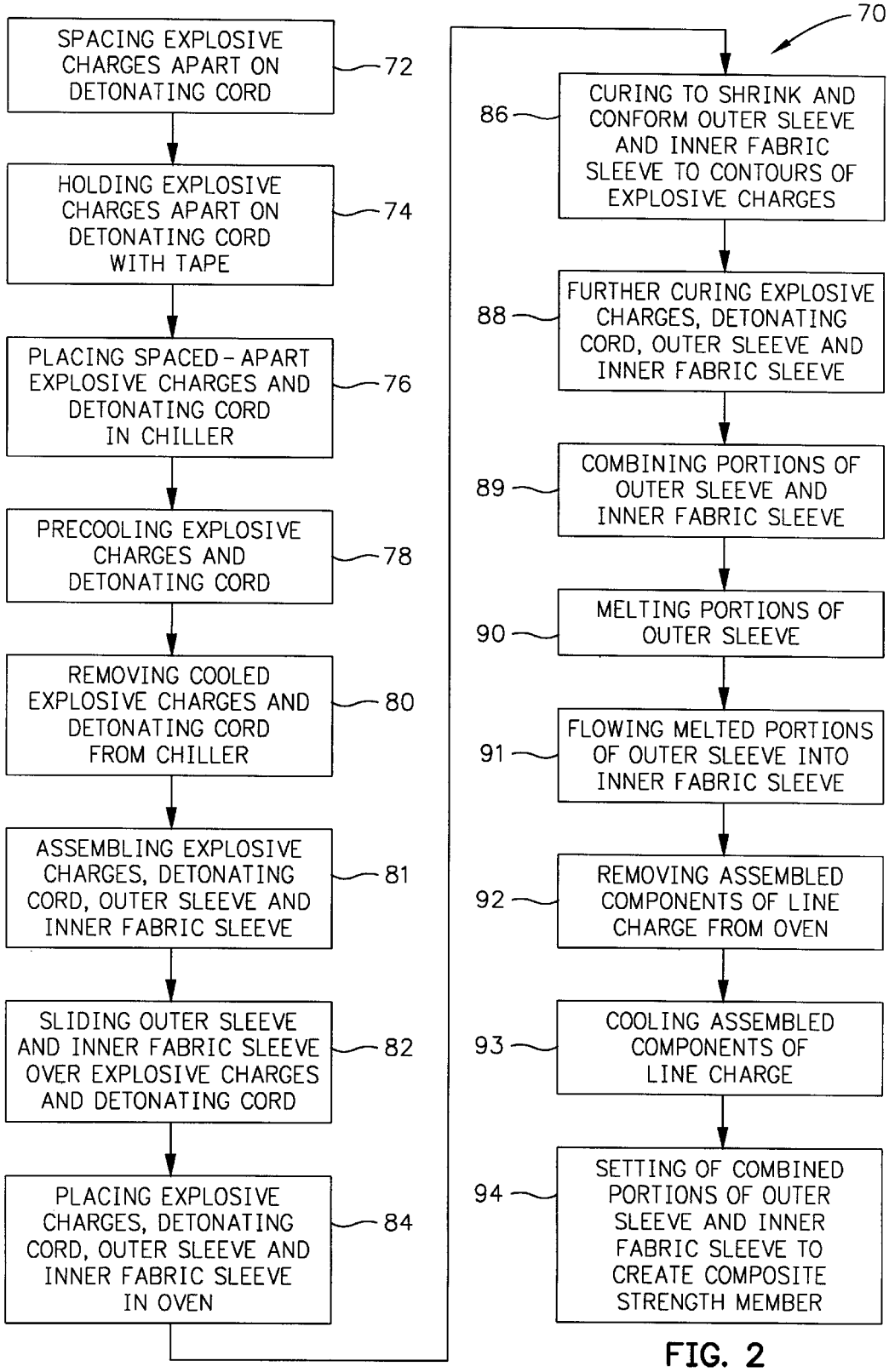
FIG. 2 depicts the method of manufacture, or assembling of the line charge according to this invention.

Referring to FIG. 2, assembly process 70 calls for spacing 72 explosive charges 15 apart on detonating cord 20 and lightly holding 74 explosive charges 15 spaced apart on detonating cord 20 by tape strips 21 that may be reinforced with polymeric fibers. Next placing 76 the spaced-apart subassembly of explosive charges 15 and detonating cord 20 in a chiller, such as a refrigerated room for a period of time (about one hour) effects their precooling 78 to about 25 degrees F.

Removing 80 the cooled subassembly of explosive charges 15 and detonating cord 20 from the chiller permits assembling 81 components of an assembly that includes outer thermoset/thermoplastic sleeve 40, inner fabric sleeve 30, explosive charges 15, and detonating cord 20. The step of assembling 81 includes sliding 82 outer thermoset/thermoplastic sleeve 40 and inner fabric sleeve 30 over the subassembly of explosive charges 15 and detonating cord 20 to cover their entire length. Next, placing 84 the assembled components that include outer thermoset/thermoplastic sleeve 40, inner fabric sleeve 40, explosive charges 15, and detonating cord 20 into a radiant oven that has been preheated to the range between 250 F and 650 F, effects curing 86 of the assembly. Curing 86 in this temperature range in the oven for a first period of time (about ten minutes, for example) allows outer thermoset/thermoplastic sleeve 40 to shrink and conform with inner fabric sleeve 30 to the contours of explosive charges 15. Further curing 88 the assembled components in this temperature range for a second, or additional period of time (about five minutes, for example) effects combining 89 portions of thermoset/thermoplastic material of outer sleeve 40 with inner fabric sleeve 30. Combining 89 may include melting 90 of at least portions of thermoset/thermoplastic material of outer sleeve 40 and flowing 91 at least some melted portions into fibers of inner fabric sleeve 30.

If the explosive materials for detonating cord 20 and explosive charges 15 are substantially the same as the materials for corresponding components in the above referenced "Line Charge Insensitive Munition Warhead," detonating cord 20 and explosive charges 15 can be left in the oven for a total period of time that it takes for them to reach a temperature of 160 F before ignition and/or detonation might occur. For this reason, detonating cord 20 and explosive charges 15 were subjected to the step of precooling 78 to approximately 25 degrees F. Precooling 78 helps prevent untimely ignition and/or detonation of detonating cord 20 and explosive charges 15 as inner fabric sleeve 30 and outer sleeve 40 are brought to sufficiently high temperature levels in the steps of curing 86 and further curing 88 in assembly process 70.

Removing 92 line charge 10 from the oven allows subsequent cooling 93 of the cured assembled components of line charge 10 to room temperature. The steps of removing 92 and subsequent cooling 93 assure setting 94 of combined portions of outer thermoset/thermoplastic sleeve 40 and inner fabric sleeve 30. The step of setting 94, therefore, creates composite strength member 50 that securely cradles and holds explosive charges 15 in place and guides the more fragile detonating cord 20 without frictional engaging it. In the fashion of assembly process 70 as herein described, a strong, pliable, lightweight and uniform line charge 10 is rapidly and efficiently manufactured.

Line charge 10 is an improved ordnance tool that is fabricated by improved assembly process 70 for fastening together explosive charges 15 and detonating cords 20. Line charge 10 uses inner fabric sleeve 30 fastened and contoured over explosive charges 15 by outer sleeve 40 of thermoset or thermoplastic material, that act together as composite strength member 50. Composite strength member 50 reliably cradles explosive charges 15 and assures that detonating cord 20 is not exposed to strain or damaged. Composite strength member 50 further assures a lightweight, strong, and low cost line charge 10. The light fabric sleeve 30 of composite strength member 50 is conformed to surround explosive charges 15 by shrinking thermoset/thermoplastic material of outer sleeve 40. Composite strength member 50 securely positions explosive charges 15 and absorbs excessive loading of launched explosive charges 15 via rocket, mortar, or other less severe deployment environments, such as towing, parachute laying, catapulting, and air gunning on land, over water, underwater, and underground. Line charge 10 fabricated by the rapid assembly procedure of assembly process 70 can be used for obstacle and mine clearing, surface and subsurface warfare operations, and administrative and humanitarian de-mining efforts.

Composite strength member 50 holding explosive charges 15 in specific separations in line charge 10 is not limited to single dimension systems propelled by rockets or mortars. Composite strength member 50 and modifications of it can also be used in the construction of net-array systems of warheads which space many explosive charges in two or more dimensions for either blast or directional effects. The two dimensional systems may also be used above water, underwater, or underground, and they could also be adapted as signaling devices that stream discontinuous payloads of detonation that could represent coded messages in combination with their destructive effect. Line charges 10 may be arranged in parallel horizontal net arrays, with or without pattern variations of size and position of explosive charges 15 to control enhance shock and blast effects. Horizontal line charges 10 may be interconnected parallel with vertically extending tensile strength members of textile, polymeric, or metallic construction to make two or three dimensional distributed arrays of explosive charges 15.

Inner fabric sleeve 30 has elasticity to allow line charge 10 to stretch upon launch and return to its original position, or disposition upon landing. This capability limits the peak acceleration of explosive charges 15 by spreading the launch forces over a long time pulse. Upon landing, elastic properties of inner fabric sleeve 30 give line charge 10 time to relax and return the spacings of explosive charges 15 to their original positions. Proper spacing of explosive charges 15 is maintained and explosive effectiveness of line charge 10 is maximized. Composite strength member 50 absorbs launch energy over its entire length and circumference, and is capable of absorbing more energy prior to structural failure so that more powerful rocket motors can fly longer line charges 10 from much greater and safer standoff distances.

Line charge 10 made by assembly process 70 virtually simultaneously allows for strain relief of detonating cord 20, holds explosive charges 15 in proper alignment and spacing, and additionally allows for variable shock absorption through various fabrics and weaves of inner fabric sleeve 30 and variable thermoset/thermoplastic compositions of outer sleeve 40. Reliable line charge 10 is the product of simplified assembly process 70 as compared to contemporary processes.

Line charge 10 made in accordance with assembly process 70 is relatively inexpensive, lightweight, and capable of maintaining critical spacing tolerances between explosive charges 15 for explosive effectiveness that results in effective clearing of mines and obstacles.

Line charge 10 made in accordance with assembly process 70 provides a management system for detonating cord 20 that has reduced strain loading of detonating cord 20 that is used to detonate explosive charges 15.

Inner fabric sleeve 30 may be a woven tube of fabric or a tubularly-shaped sleeve may be formed from a flat piece that is wrapped and secured by a longitudinally extending seam. The strength of the seam made by known fastening methods may be augmented by inserting glue, epoxy, and thermosetting or thermoplastic polymers/adhesives along the length of the seam and activating them in customary fashion. Outer thermoset/thermoplastic sleeve 40 may then be placed over this fabric sleeve 30 and secured by heat shrinking as mentioned above. Assembly process 70 could be repeated to create overlapped composite strength members 50 to increase or control the levels of strength, flexibility, and stiffness needed throughout the axis of line charge 10.

Accordingly, having this disclosure in mind, one skilled in the art to which this invention pertains will select and assemble various components from among a wide variety available in the art. Therefore, this disclosure is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. A line charge having a composite strength member conforming to a plurality of explosive charges, said explosive charges each having a longitudinal passageway to permit free longitudinal travel of a detonating cord therein, said composite strength member having an inner fabric sleeve covered by an outer sleeve of thermoset/thermoplastic material to shape and hold said inner fabric sleeve on said explosive charges and to permit said free longitudinal travel of said detonating cord through said explosive charges.

2. A line charge according to claim 1 in which said composite strength member separates and cradles said explosive charges in contiguous abutment during deployment of said line charge.

3. A line charge according to claim 2 in which said composite strength member stretches to absorb shock during said deployment and after landing returns to its original position to allow detonation of said explosive charges at critical spacings for explosive effectiveness of said explosive charges.

4. A line charge according to claim 3 in which said composite strength member contains said detonating cord in a virtually friction-free relationship to assure free longitudinal travel of said detonation cord therein during said deployment.

5. A line charge according to claim 4 in which detonating cord is longer than said composite strength member to prevent loading thereof as said composite strength member stretches during said deployment.

6. A line charge according to claim 4 in which said composite strength member has said thermoset/thermoplastic material of said outer sleeve combined with said inner fabric sleeve to cradle said explosive charges in contiguous abutment during said deployment.

7. A line charge according to claim 6 further including:

tape strips each connected to one end of a separate one of said explosive charges and to said detonating cord to maintain said explosive charges in a predetermined spaced-apart relationship with respect to one another along said detonating cord.

8. A line charge according to claim 7 further including:

linking portions of said tape strips extending between adjacent ones of said tape strips to maintain the configuration of additional short lengths of said detonating cord to thereby assure greater length of said detonating cord as compared to the length of said composite strength member.

9. A line charge according to claim 8 further including:

sleeves of low-friction material around said detonating cord and said short lengths where they extend between adjacent ones of said explosive charges to reduce the possibility of frictional engagement of said detonating cord by said composite strength member.

10. A line charge according to claim 9 in which said thermoset/thermoplastic material is made from flexible and strong shrinkable products, and said inner fabric sleeve is made from high strength flexible fibers comprising natural fibers including cotton and linen, and man-made high strength fibers.

* * * * *